US006502528B1

(12) United States Patent
MacLeod et al.

(10) Patent No.: US 6,502,528 B1
(45) Date of Patent: Jan. 7, 2003

(54) PRESSURE-BALANCED GAS TURBINE UNDERWATER LAUNCHER

(75) Inventors: Brenda Brennan MacLeod, Nashua, NH (US); Paul E. Moody, Barrington, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/932,722

(22) Filed: Aug. 20, 2001

(51) Int. Cl.[7] ..... B63G 8/28
(52) U.S. Cl. ..... 114/319; 89/1.809; 114/238
(58) Field of Search ..... 114/318, 238, 114/316, 319, 320; 89/1.809

(56) References Cited

U.S. PATENT DOCUMENTS 3,088,377 A * 5/1963 Siegel ..... 89/1.81
3,137,203 A * 6/1964 Brown ..... 102/411
3,499,364 A * 3/1970 D'Ooge ..... 89/1.81
4,185,538 A * 1/1980 Barakauskas ..... 89/1.81

FOREIGN PATENT DOCUMENTS

DE 41 12 778 A1 * 10/1992

* cited by examiner

*Primary Examiner*—Sherman Basinger
(74) *Attorney, Agent, or Firm*—Michael J. McGowan; Michael F. Oglo; James M. Kasischke

(57) ABSTRACT

An underwater launcher of a vehicle in a launching tube outside the pressure hull of a submerged launch platform is unaffected by launch depth. A muzzle cap at one end of the tube communicates with ambient water and a ram plate at the other end communicates through openings with ambient water. Rigid elongate segments extend inside the tube between the cap and the plate, and a launch mechanism connected to the platform and tube has an expansion chamber sealed from ambient water and contains a gas driven turbine rotating a pump-inducer communicating through the openings with the ambient water. The pump inducer is adjacent to the plate to simultaneously displace the plate, elongate segments, vehicle, and cap in the tube and eject the vehicle. The plate, elongate segments, and cap decouple from the vehicle as it leaves the tube and safely sink away from the launch platform.

13 Claims, 2 Drawing Sheets

PRESSURE-BALANCED GAS TURBINE UNDERWATER LAUNCHER

STATEMENT OF GOVERNMENT INTEREST

The invention described herein may be manufactured and used by or for the Government of the United States of America for governmental purposes without the payment of any royalties thereon or therefor.

CROSS-REFERENCE TO RELATED PATENT APPLICATIONS

Not applicable.

BACKGROUND OF THE INVENTION (1) Field of the Invention

The present invention relates generally to a launcher of vehicles from outside the pressure hull of an undersea craft. More particularly, this invention relates to a launcher whose performance will not be affected by differences in sea pressure as it relates to depth of the craft at the time of firing.

(2) Description of the Prior Art

Currently, an existing launch system located outside the pressure hull of a submersible craft utilizes a gas generator to build up pressure on the breech end of a vehicle to be launched, which is greater than the sea pressure on the muzzle end of the vehicle. This pressure differential results in an imbalance of force that launches the vehicle. However, as the craft submerges deeper and deeper, the pressure on the muzzle end of the vehicle increases due to increased sea pressure. This results in a variation of ejection profiles, depending on the depth in which a launch is made and ultimately, could result in damage to the vehicles and failure of the mission.

Thus, a need has been recognized in the state of the art for a submerged launcher of vehicles that avoids the problems associated with pressure differences associated with the launcher's depth at the time of launch.

SUMMARY OF THE INVENTION

The first object of the invention is to provide an improved capability of launching vehicles from outside the pressure hull of a submerged launch platform.

Another object is to provide a launcher of vehicles that eliminates the pressure differential attributed to ambient sea pressure from impacting the dynamics of launch.

Another object is to provide a submerged launcher of vehicles operating independently from sea pressure to improve reliability.

Another object is to provide a submerged launcher of vehicles having reduced complexity and costs and being more easily installed than contemporary launch systems.

Another object is to provide a launcher of vehicles located outside the pressure hull of a submerged launch platform providing for full launch stroke along the length of the launch tube.

Another object of the invention is to provide a launcher for a submerged vehicle completely de-coupling supporting structure as the vehicle leaves the launch tube to allow the supporting structure to sink away from the launch platform.

These and other objects of the invention will become more readily apparent from the ensuing specification when taken in conjunction with the appended claims.

Accordingly, the present invention is a launcher of a vehicle that is located outside the pressure hull of a submerged launch platform that is virtually unaffected by depth of launch. A muzzle cap at the muzzle end of the launching tube communicates with the ambient water and a ram plate at the other end communicates through openings with the ambient water. Rigid elongate elements extend between the muzzle cap and the ram plate inside the launching tube, and a launch mechanism is disposed in the ambient water and connected to the launch platform and the launching tube. The launch mechanism has an expansion chamber sealed from the ambient water containing a gas driven turbine coupled to rotate a pump-inducer in an inducer chamber that communicates with the ambient water through the openings. The pump inducer is adjacent the ram plate to impart simultaneously longitudinal displacement of the ram plate, the rigid elongate elements, the vehicle, and the muzzle cap in the launching tube and thereby provides for the ejection of the vehicle.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals refer to like parts and wherein.

DESCRIPTION OF THE PREFERRED EMBODIMENT

Figure 1:
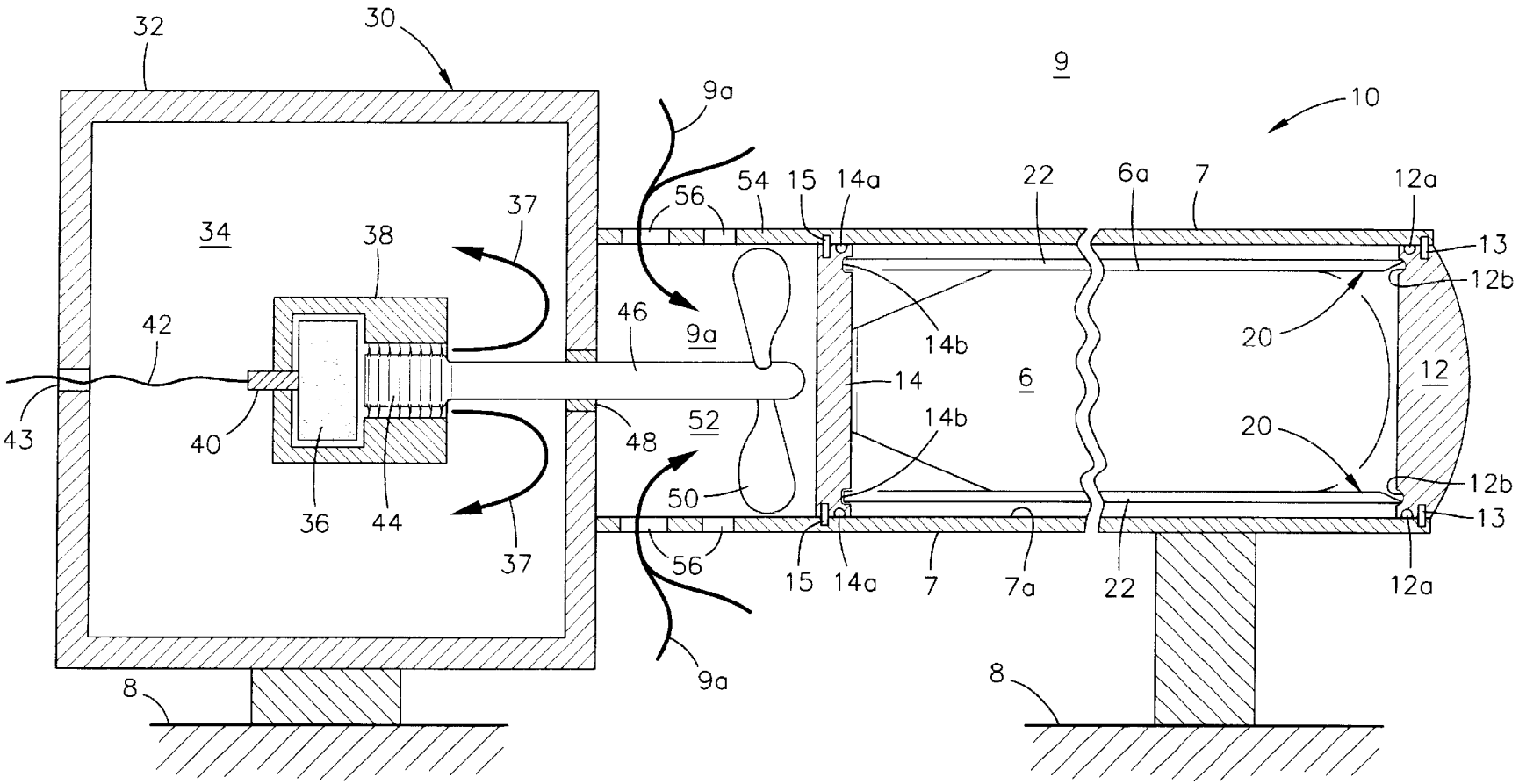
FIG. 1 is a cross-sectional schematic side view of the launcher of this invention for launching a vehicle from a submerged launch platform.
Figure 2:
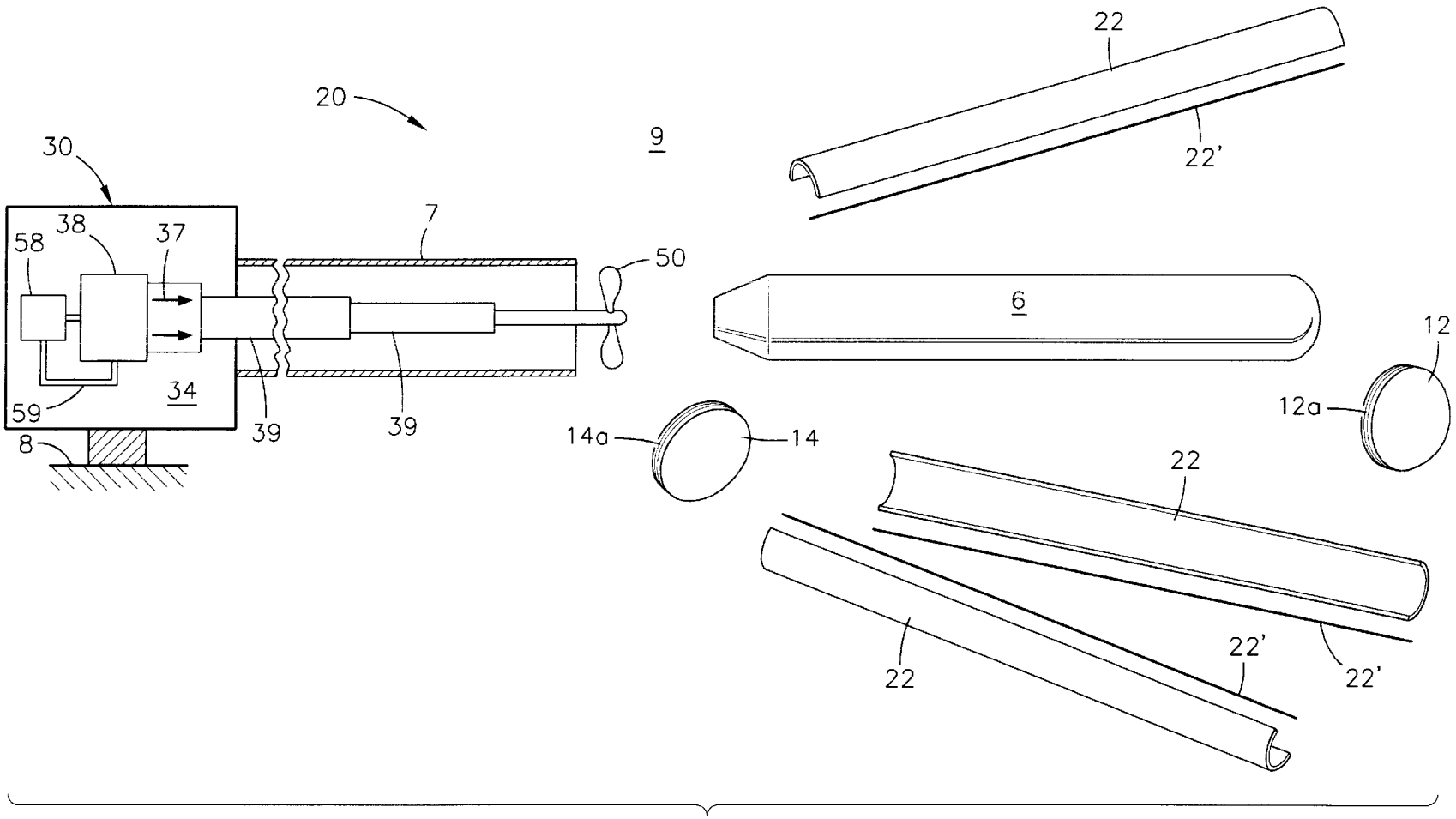
FIG. 2 is a schematic side view of portions of the launcher in the post-launch configuration outside of the launch tube on the launch platform.

Referring to FIGS. 1 and 2 of the drawings, launcher 10 of this invention is designed to launch a vehicle 6 from a launching tube 7 located outside the pressure hull of a submerged launch platform 8 in ambient water 9, such as seawater. Vehicle 6 can be a torpedo or missile that is ejected from launching tube 7 into seawater 9 and then proceeds to a distant target. Submerged launch platform 8 may be a submarine, fixed underwater installation or any one of a variety of contemporary manned or unmanned submersibles.

Launcher 10 of this invention is adaptable for use externally on all of these platforms in ambient seawater 9. Launcher 10 eliminates the effects of variation of ambient sea pressure from the launch profile of vehicle 6 that is stowed and positioned in launch tube 7 between a muzzle cap 12 for tube 7 and ram plate 14. Both muzzle cap 12 and ram plate 14 are sealed within tube 7 with O-rings 12*a* and 14*a* to block any of ambient seawater 9 from coming in contact with vehicle 6. This sealing minimizes the likelihood of producing any corrosion that otherwise might be caused by seawater from impacting the performance of vehicle 6 after it is launched. In addition to being sealed within the dry and air filled tube 7, muzzle cap 12 (at the muzzle end of vehicle 6) and ram plate 14 (adjacent to and in contact with the other end of vehicle 6) additionally are retained in launch tube 7 by shear pins 13 and 15 that extend from launch tube 7 and into muzzle cap 12 and ram plate 14, respectively.

A sabot 20 is held between and in contact with muzzle cap 12 and ram plate 14. Sabot 20 is made up of a plurality of rigid elongate segments 22 that are sized to fit between an inner surface 7*a* of launch tube 7 and an outer surface 6*a* of vehicle 6 and slide along inner surface 7*a* of launch tube 7 during ejection of vehicle 6 from launch tube 7. Together elongate segments 22 extend to virtually cover the length of vehicle 6 between muzzle cap 12 and ram plate 14.

Rigid elongate segments 22 of sabot 20 are not physically attached to either muzzle cap 12 or ram plate 14 but instead are loosely fitted into small, appropriately-shaped, aligned recesses 12*b* and 14*b* in muzzle cap 12 and ram plate 14 to symmetrically position elongate rigid segments 22 around vehicle 6. Rigid elongate segments 22 of sabot 20 thusly transmit any force that may be applied on ram plate 14 that might be caused by variations of sea pressure from ram plate 14 to muzzle cap 12. Since muzzle cap 12 and ram plate 14 have identical diameters where they are sealed in launch tube 7, forces are balanced in both directions. Rigid elongate segments 22 of sabot 20 prevent the shear pins 13 and 15 of muzzle cap 12 and ram plate 14 from failing (shearing) prematurely due to sea pressure and additionally prevent force attributed to ambient sea pressure from being transmitted through vehicle 6. Additionally, shear pins 13 and 15 prevent the assembly from moving due to structural vibration. When launcher 10 is activated and vehicle 6 is ejected from launching tube 7 along with sabot 20, rigid elongate segments 22 of sabot 20 individually fall out of their recesses 12*b* and 14*b* of muzzle cap 12 and ram plate 14 and sink away from launch platform 8 along with muzzle cap 12 and ram plate 14, (FIG. 2). This supporting structure falls out of the way and does not interfere with safe ejection and further travel of vehicle 6.

Launcher 10 has a launch mechanism 30 used to forcefully eject vehicle 6 from launching tube 7 and into ambient seawater 9. Launch mechanism 30 has an expansion chamber housing 32 for an expansion chamber 34 sealed from ambient water 9. A solid propellant 36 contained in a strong block 38 of high-strength, refractory material, is connected to a propellant igniter 40. Propellant igniter 40 has an electrical lead 42 extending through a sealed fitting 43 in housing 32 to a remotely located control panel (not shown). A suitable signal from the control panel initiates igniter 40 to ignite propellant 36 that produces gases 37.

A multi-stage gas turbine 44 is disposed adjacent solid propellant 36 to receive expanding gases 37 from burning propellant 36. Gases 37 expand through turbine 44 to rotate turbine 44 forcefully and then gases 37 are vented to expansion chamber 34. Turbine 44 is connected to a shaft 46 that extends through a combination thrust-bearing journal 48 to transmit the forceful rotation of turbine 44 to a propeller-like pump-inducer 50 in inducer chamber 52 of inducer housing 54. Openings 56 provided in the circumferentially disposed walls of inducer housing 54 allow a portion 9*a* of ambient water 9 to flow into inducer chamber 52.

Rotation of pump-inducer 50 creates a pressure build-up on ram plate 14 adjacent to inducer chamber 52. This pressure build-up on ram plate 14 is additive to ambient sea pressure coupled to inducer chamber 52 via openings 56 of inducer housing 54. Openings 56 assure that the pressure on ram plate 14 is virtually the same as the ambient sea pressure on muzzle cap 12 prior to the build up of pressure created by the rotation of pump inducer 50. However, the pressure build-up on ram plate 14 that is created by rotation of pump-inducer 50 will shear pins 15 of ram plate 14 and pins 13 of muzzle cap 12 (via the pressure build-up force transmitted through ram plate 14 and rigid elongate segments 22 of sabot 20) and impart longitudinal displacement of ram plate 14 in launch tube 7. This longitudinal displacement will continue as rotating pump-inducer 50 continues to build-up pressure on ram plate 14 and it pushes out, or ejects vehicle 6 from launch tube 7.

Ram plate 14, rigid elongate segments 22 of sabot 20 and muzzle cap 12 will be ejected virtually simultaneously along with vehicle 6. Substantially the same magnitude of pressure build-up created by rotating pump-inducer 50 will eject vehicle 6, ram plate 14 sabot 20 and muzzle cap 12 irrespective of different depths because the ambient pressures at these different depths are simultaneously transmitted to both muzzle cap 12 and ram plate 14. Sabot 20 extending between muzzle cap 12 and ram plate 14 prevents any possible pressure differentials from being transmitted to vehicle 6. Openings 56 additionally reduce the possibility of cavitations of pump-inducer 50 since more of portions 9*a* of seawater 9 is freely fed to pump-inducer 50 as it continues to increase the pressure build-up behind ram plate 14 during longitudinal displacement of ram plate 14, sabot 20, vehicle 6, and muzzle cap 12.

Other means for generation of gases for pump-inducer 50 could have been selected, for example, airbag inflators, high-pressure gas sources, and liquid or gelled propellants could have been substituted for solid propellant 36 and its associated components. In addition, sabot 20 made up of rigid elongate segments 22 that cover the length of vehicle 6 could have been modified to be several rigid elongate tie-rod-like members 22' in place of or in combination with rigid elongate segments 22 (FIG. 2) extending between muzzle cap 12 and ram plate 14 to transmit the loads associated with launch of vehicle 6. Tie rod-like members 22' would extend between and abut both muzzle cap 12 and ram plate 14 and loosely fit into small, suitably shaped, aligned recesses 12*b* and 14*b* much like rigid elongate segments 22. But, since they do not cover vehicle 6 like segments 22, they might vibrate, or twist loose during launching of vehicle 6. Consequently, launching tube 7 might have to be longitudinally slotted to guide the tie rod-like members themselves, or lateral extensions of the tie rod-like members that could ride in the slots in tube 7 to assure reliable deployment. Another option is to provide a piston-like device 58 receiving some of expanding gases 37 through duct 59. Device 58 thereby displaces gas turbine 44, shaft 46, and pump-inducer 50 (interconnected as a unit) forward against ram plate 14, to shear pins 15 and pins 13 via sabot 20 prior to rotation of turbine 44 and pump-inducer 50. The displacing forces generated by turbine 44 might be augmented by or dispensed with and replaced with the forces generated by a telescoping tube mechanism 39. Telescoping tube mechanism 39 can receive some of expanding gasses 37 and extend to displace pump-inducer 50 which pushes against ram plate 14, that shears pins 15 and pins 13 via sabot 20 and ejects vehicle 6 and rigid elongate segments 22 of sabot 20 from launch tube 7.

Launcher 10 eliminates pressure differentials attributed to ambient seawater 9 on vehicle 6 from impacting its launch dynamics. This improvement allows mission planners and operators to eliminate one variable from the complex hydrodynamic analysis associated with predicting launch dynamics and trajectories of vehicle 6 launched from underwater platforms. Launcher 10 is an improvement over contemporary pressure-balanced systems because (1) launcher 10 allows for a full stroke length along the length of launch tube 7 and (2) launcher 10 eliminates the problem of maintaining sea pressure at the aft end of an accelerating projectile.

The disclosed components and their arrangements as disclosed herein all contribute to the novel features of this invention. Launcher 10 of this invention provides a reliable and cost-effective means to improve the capabilities of the launchers for underwater platforms. Therefore, the launcher as disclosed herein is not to be construed as limiting, but rather, is intended to be demonstrative of this inventive concept.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An apparatus for launching a vehicle underwater comprising:

a launching tube having a muzzle cap at one end communicating with ambient water and a ram plate at the other end communicating through openings with said ambient water, said launching tube containing a launch vehicle therein;

a plurality of rigid elongate elements extending from said muzzle cap to said ram plate inside said launching tube and adjacent said vehicle, said rigid elongate elements each having opposite ends contacting said muzzle cap and said ram plate, respectively; and a launch mechanism disposed in said ambient water and connected to said launching tube, said launch mechanism imparting a force against said ram plate to simultaneously displace said ram plate, said rigid elongate elements, said vehicle, and said muzzle cap with respect to said launching tube to eject said vehicle from said launching tube.

2. An apparatus for launching a vehicle underwater comprising:

a launching tube having a muzzle cap at one end communicating with ambient water and a ram plate at the other end communicating through openings with said ambient water, said launching tube containing a launch vehicle therein;

a plurality of rigid elongate elements extending between said muzzle cap and said ram plate inside said launching tube and adjacent said vehicle, said rigid elongate elements being loosely fitted into aligned recesses in said muzzle cap and said ram plate to separate from one another and sink during ejection of said vehicle; and a launch mechanism disposed in said ambient water and connected to said launching tube, said launch mechanism imparting a force against said ram plate to simultaneously displace said ram plate, said rigid elongate elements, said vehicle, and said muzzle cap with respect to said launching tube to eject said vehicle from said launching tube.

3. The apparatus of claim 2 wherein said rigid elongate elements are sized to fit between an inner surface of said launch tube and an outer surface of said vehicle as a sabot permitting sliding longitudinal displacement thereof along said inner surface of said launch tube.

4. The apparatus of claim 3 wherein said muzzle cap and said ram plate are connected to said launching tube by shear pins, said force imparted by said launch mechanism shearing said shear pins of said ram plate and said shear pins of said muzzle cap to allow said displacement.

5. The apparatus of claim 4 wherein said launch mechanism has an expansion chamber sealed from said ambient water containing a gas driven turbine coupled to rotate a pump-inducer in an inducer chamber communicating with said ambient water through said openings, said pump inducer being disposed adjacent said ram plate to create a pressure build-up on said ram plate.

6. The apparatus of claim 5 wherein said launch mechanism has a source of gas in a block containing said turbine to vent gases through said turbine and into said expansion chamber.

7. The apparatus of claim 6 wherein said launch mechanism includes a shaft extending through a thrust-bearing journal in an expansion chamber housing containing said expansion chamber, said shaft connecting said turbine to said pump-inducer to rotate said pump-inducer and create said pressure build-up on said ram plate to effect said longitudinal displacement and ejection of said vehicle.

8. The combination of claim 7 wherein said openings are provided in circumferentially disposed walls of an inducer housing to allow part of said ambient water to flow into said inducer chamber.

9. The apparatus of claim 8 wherein said openings reduce the possibility of cavitations of said pump-inducer by feeding more of said ambient water to said pump-inducer during said longitudinal displacement.

10. The apparatus of claim 9 wherein said openings assure that the pressure on said ram plate is virtually the same as the pressure of said ambient water on said muzzle cap prior to launching the vehicle.

11. The apparatus of claim 10 wherein said source of gas is a solid propellant coupled to an igniter having an electrical lead extending through a sealed fitting in said expansion chamber housing.

12. The apparatus of claim 11 wherein said source of gas may be selected from one of group of means for generating gases consisting of airbag inflators, high-pressure gas sources, liquid and gelled propellants.

13. The apparatus of claim 2 wherein said rigid elongate elements are several rigid elongate tie-rod-like members extending between and abutting said muzzle cap and said ram plate to transmit the loads associated with launch of said vehicle.

* * * * *